US008807966B2

(12) United States Patent
Du et al.

(10) Patent No.: US 8,807,966 B2
(45) Date of Patent: Aug. 19, 2014

(54) PUMP MOTOR PROTECTOR WITH REDUNDANT SHAFT SEAL

(75) Inventors: Michael Hui Du, Pearland, TX (US); Arthur I. Watson, Sugar Land, TX (US); David Rowatt, Jurong (SG); Chad Bremner, Westhill (GB); Arunkumar Arumugam, Missouri City, TX (US); David Garrett, Bartlesville, OK (US); Christopher Featherby, Bartlesville, OK (US); Ramez Guindi, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 871 days.

(21) Appl. No.: 12/669,866

(22) PCT Filed: Jul. 18, 2008

(86) PCT No.: PCT/US2008/070529

§ 371 (c)(1),
(2), (4) Date: Apr. 13, 2010

(87) PCT Pub. No.: WO2009/015035

PCT Pub. Date: Jan. 29, 2009

(65) Prior Publication Data

US 2010/0202896 A1 Aug. 12, 2010

Related U.S. Application Data

(60) Provisional application No. 60/951,080, filed on Jul. 20, 2007.

(51) Int. Cl.

| | |
|---|---|
| ***F04B 39/00*** | (2006.01) |
| ***F04D 29/10*** | (2006.01) |
| ***F04D 13/10*** | (2006.01) |

(52) U.S. Cl.

CPC ..... *F04D 13/10* (2013.01); *F04D 29/106* (2013.01)

USPC ..... 417/414; 417/423.11

(58) Field of Classification Search

USPC ..... 417/414, 423.3, 423.11; 166/68, 105, 166/88, 85.1, 85.3, 351, 360, 369, 372, 378, 166/387, 105.4, 106, 107, 112; 277/634, 277/635

See application file for complete search history.

(56) References Cited

U.S. PATENT DOCUMENTS

| | | | | | |
|---|---|---|---|---|---|
| 1,879,628 | A | * | 9/1932 | Mendenhall et al. | 310/87 |
| 2,455,022 | A | * | 11/1948 | Schmidt | 417/99 |
| 2,489,505 | A | * | 11/1949 | Schmidt | 417/339 |
| 2,569,741 | A | * | 10/1951 | Arutunoff | 310/87 |
| 2,942,667 | A | * | 6/1960 | Bridwell et al. | 277/333 |
| 4,011,906 | A | * | 3/1977 | Alexander et al. | 166/105 |
| 4,421,999 | A | * | 12/1983 | Beavers et al. | 310/87 |
| 5,134,328 | A | | 7/1992 | Johnatakis et al. | |
| 5,622,222 | A | * | 4/1997 | Wilson et al. | 166/105.4 |

(Continued)

OTHER PUBLICATIONS

Chinese Office Action dated Dec. 1, 2011 for corresponding CN application No. 200880103689.3.

*Primary Examiner* — Charles Freay
*Assistant Examiner* — Philip Stimpert
(74) *Attorney, Agent, or Firm* — Michael Stonebrook

(57) ABSTRACT

An electric submersible pump device having a motor part, a pump part, and a protector part. The protector part includes redundant shaft seal parts.

9 Claims, 6 Drawing Sheets

(56) References Cited

U.S. PATENT DOCUMENTS

| | | | | |
|---|---|---|---|---|
| 6,015,266 | A * | 1/2000 | Swatek | 417/53 |
| 6,242,829 | B1 * | 6/2001 | Scarsdale | 310/87 |
| 6,268,672 | B1 * | 7/2001 | Straub et al. | 310/87 |
| 6,307,290 | B1 * | 10/2001 | Scarsdale | 310/87 |
| 6,554,580 | B1 * | 4/2003 | Mayfield et al. | 417/56 |
| 6,602,059 | B1 * | 8/2003 | Howell et al. | 417/423.3 |
| 6,981,853 | B2 * | 1/2006 | Du et al. | 417/414 |
| 7,387,157 | B2 * | 6/2008 | Gambier et al. | 166/187 |
| 7,665,975 | B2 * | 2/2010 | Parmeter et al. | 417/423.11 |
| 7,741,744 | B2 * | 6/2010 | Watson et al. | 310/87 |
| 7,753,129 | B2 * | 7/2010 | Head | 166/385 |
| 2004/0069501 | A1 * | 4/2004 | Haugen et al. | 166/381 |
| 2005/0077040 | A1 * | 4/2005 | Meyers et al. | 166/85.2 |
| 2007/0074872 | A1 | 4/2007 | Du et al. | |
| 2011/0014071 | A1 * | 1/2011 | Du et al. | 417/414 |
| 2011/0042097 | A1 * | 2/2011 | Stephenson et al. | 166/369 |
| 2012/0305253 | A1 * | 12/2012 | O'Malley | 166/302 |

* cited by examiner

PUMP MOTOR PROTECTOR WITH REDUNDANT SHAFT SEAL

RELATED APPLICATION

This application claims benefit from U.S. application No. 60/951,080 filed Jul. 20, 2007 incorporated in its entirely herein.

TECHNICAL FIELD

The present application relates to electric submersible motors and pumping systems, and more particularly, to shaft seals and motor protector devices in connection therewith.

BACKGROUND

Fluids are located underground. The fluids can include hydrocarbons (oil) and water, for example. Extraction of at least the oil for consumption is desirable. A hole is drilled into the ground to extract the fluids. The hole is called a wellbore and is oftentimes cased with a metal tubular structure referred to as a casing. A number of other features such as cementing between the casing and the wellbore can be added. The wellbore can be essentially vertical, and can even be drilled in various directions, e.g. upward or horizontal.

Once the wellbore is cased, the casing can be perforated. Perforating involves creating holes in the casing thereby connecting the wellbore outside of the casing to the inside of the casing. That can be done by lowering a perforating gun into the casing. The perforating gun has charges that detonate and propel matter through the casing thereby creating the holes in the casing and the surrounding formation to help formation fluids flow from the formation and wellbore into the casing.

Sometimes the formation has enough pressure to drive well fluids uphole to surface. However, that situation is not always present and cannot be relied upon. Artificial lift devices can therefore be used to drive downhole well fluids uphole, e.g., to surface. The artificial lift devices are placed downhole inside the casing. An artificial lift device often has an electric motor with internal parts. Preventing well fluids from reaching component parts of the motor is desirable.

SUMMARY

Figure 1:
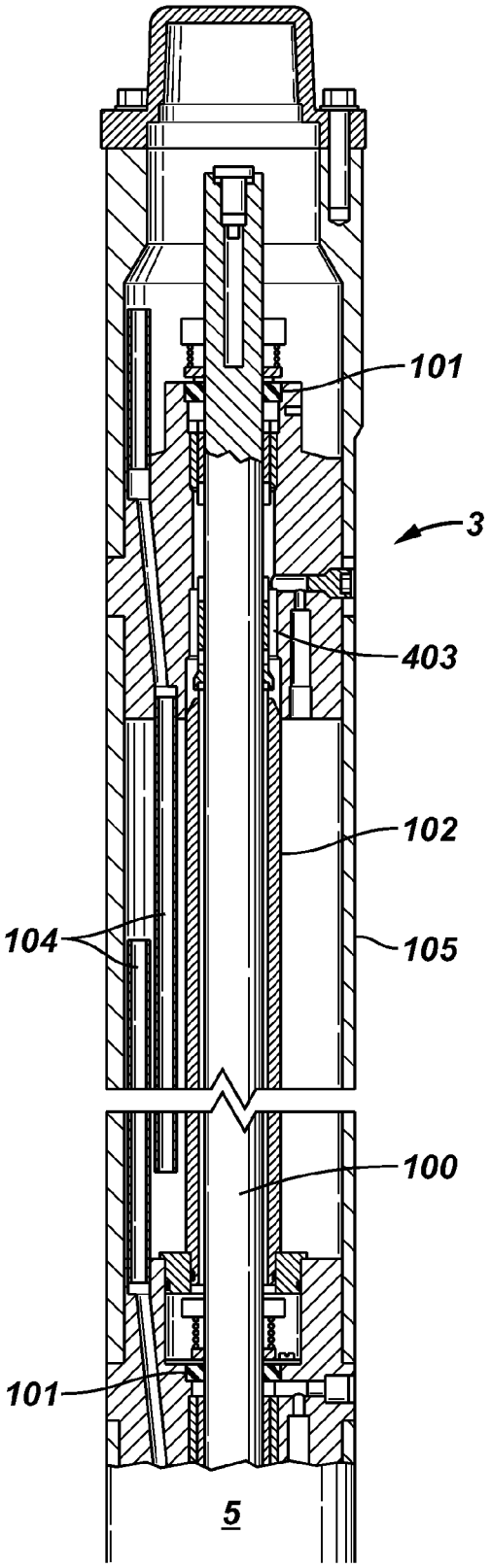
FIG. 1 shows embodiments of features.

The following descriptions of certain features are exemplary and are not to limit the claim scope or overall disclosure in any way.

An embodiment of features includes an electric submersible pump device having an electric submersible motor part that produces torque having coupled thereto a drive shaft that transmits the torque. The drive shaft extends in an axial direction from the motor part. A protector part coupled with the motor part. The drive shaft extends into the protector part. The protector part comprises a tubular shaped casing extending in the axial direction. A shaft tube surrounds a portion of the drive shaft thereby defining a space between the outer surface of the shaft and an interior of the shaft tube. An opening in the shaft tube connects the interior of the shaft tube with an exterior of the shaft tube. A first compensating element is connected with the opening. The first compensating element is an expandable and contractible vessel defining a volume that is correspondingly expandable and contractible.

Another embodiment of features includes an electric submersible pump device comprising an electric submersible motor part that produces torque. The electric submersible motor part has coupled thereto a drive shaft that transmits the torque. The drive shaft extends in an axial direction from the motor part. A pump part is rotationally coupled with the drive shaft. A protector part is coupled between the motor part and the pump part. The drive shaft extends into the protector part. The protector part comprises a tubular shaped casing extending in an axial direction having an inner surface defining an inner volume. A first shaft seal part is located inside the volume and divides the volume into an upper volume and a lower volume. The first shaft seal part comprises a first relief valve biased to only allow flow away from the motor part. A second shaft seal part is located inside the volume and divides the upper volume. The second shaft seal part comprises a second relief valve biased to only allow flow away from the first shaft seal part and the motor part. A first compensating element compensates pressure across the second shaft seal divide. The first compensating element is an expandable and contractible vessel defining an interior volume that is correspondingly expandable and contractible. At least one motor compensating element is in fluid communication with the motor part to compensate for thermal expansion and contraction of fluid in the motor part. During thermal fluid contraction a volume of fluid is between the first shaft seal part and the second shaft seal part and is prevented from fluidly flowing back into the motor part sufficiently to contribute more than half of the contraction compensation of fluid in the motor part.

Another embodiment of features includes a method including filling the motor part with motor fluid; running the motor and increasing temperature of the motor fluid and inducing thermal expansion of the motor fluid into the at least one motor compensating element beyond the maximum capacity of the at least one motor compensating element and forcing fluid through the first relief valve into the upper volume; subsequently lowering the temperature of the motor part and the motor fluid remaining in the motor part to induce thermal contraction of the motor fluid in the motor part and compensating for the thermal contraction by contracting the at least one motor compensation element; and preventing return of the motor fluid that traveled through the first biased relief valve during contraction compensation.

The above combinations of features are merely illustrative of some preferred embodiments and are not meant in any way to limit the overall scope of the present claims or any claims to which the applicants are entitled.

DETAILED DESCRIPTION

In the following description, numerous details are set forth to provide an understanding of the presently claimed subject matter. However, it will be understood by those skilled in the art that the present embodiments may be practiced without many of these details and that numerous variations or modifications from the described embodiments may be possible.

In the specification and appended claims: any of the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments. Moreover, the term "sealing mechanism" includes: packers, bridge plugs, downhole valves, sliding sleeves, baffle-plug combinations, polished bore receptacle (PBR) seals, and all other methods and devices for temporarily blocking the flow of fluids through the wellbore. Furthermore, while the term "coiled tubing" may be used, it could actually be replaced by jointed tubing or any relatively small diameter tubing for running downhole.

A submersible pumping system can comprise several parts, such as a submersible electric motor part and a pump part. The submersible electric motor part supplies energy to the submersible pump part. The energy is transmitted by generating torque in the motor part and transmitting the torque that is transmitted to a drive shaft coupled with the motor part. The pump is preferably a centrifugal style pump or other rotating pump that uses the torque from the drive shaft to drive rotating impellers to drive well fluid. The system further may comprise a variety of additional components, such as a connector used to connect the submersible pumping system to a deployment system. Production tubing, cable and coiled tubing can be included as the connector. Power can be supplied to the submersible electric motor part via a power cable that runs through or along the deployment system.

Often, the subterranean environment (specifically the well fluid) and fluids that are injected from the surface into the wellbore (such as acid treatments) contain corrosive compounds that may include CO2, H2S and brine water. Those corrosive agents can be detrimental to components of the submersible pumping system, particularly to internal electric motor components, such as copper windings and bronze bearings. Moreover, irrespective of whether or not the fluid is corrosive, if the fluid enters the motor and mixes with the motor oil, the fluid can degrade dielectric and lubricating properties of the motor oil and insulating materials of motor components. Accordingly, it is desirable to keep those external fluids out of internal motor fluid and motor components. One possible mode of entrance into the motor part is by way of areas interfaces between the motor part and the drive shaft. Other interfaces are also potential entrances.

Another factor to consider is thermal expansion and/or contraction of motor fluids. For example, a submersible motor can be internally filled with a fluid, such as a dielectric oil, that facilitates cooling and lubrication of the motor during operation. In many applications, submersible electric motors are subject to considerable temperature variations due to the subterranean environment, injected fluids, and other internal and external factors. Those temperature variations may subject the fluid to expansion and contraction. For example, the high temperatures common to subterranean environments may cause the motor fluid to expand beyond a maximum capacity of the motor part thereby causing leakage and other mechanical damage to the motor components. Similarly, undesirable fluid expansion and motor damage can result from the injection of high-temperature fluids, such as steam, into the submersible pumping system. Further, after expansion, thermal contraction upon cooling of motor fluid can draw well fluids back into the motor carrying undesirable compounds noted earlier.

Accordingly, a submersible motor can benefit from an electric submersible motor protector that accommodates expanding/contracting motor fluid while maintaining protection against ingress of well fluids. Also, the internal pressure of the motor could potentially be allowed to equalize or at least substantially equalize with the surrounding pressure found within the wellbore. As a result, it becomes less difficult to prevent the ingress of external fluids into the motor fluid and internal motor components.

Also, a submersible motor can benefit from having a protector with redundant shaft seal parts isolating volumes of fluid there between, the shaft seal parts having compensator elements to accommodate thermal expansion and contraction of the fluids.

Also, a submersible motor can benefit from having a protector that is hydraulically connected with the motor part so that excess fluid can escape the motor part 1 upon thermal expansion, and expansion compensation can occur along with a release of excess fluid beyond the compensator's capacity, thereby relieving a danger of overfilling a motor part or protector with too much fluid.

Many configurations of electrical submersible pump (ESP) protectors include a labyrinth seal as part of a labyrinth protector. FIG. 1 shows a portion of a protector part 3 of an electric submersible pump unit. A shaft tube 102 in the protector part 3 has a communication path 403 near the top of the shaft tube 102. The function of the communication path 403 is to pressure balance a space inside the shaft tube 102 so that the shaft seals 101 on top and at bottom of the shaft tube 102 will not see either excessive positive pressure or excessive negative pressure, which is beneficial to the proper functioning of the shaft seals 101. In some applications, such as the SAGD horizontal well, a labyrinth protector 104 is installed in the protector part 3 for settling the well debris.

Figure 2:
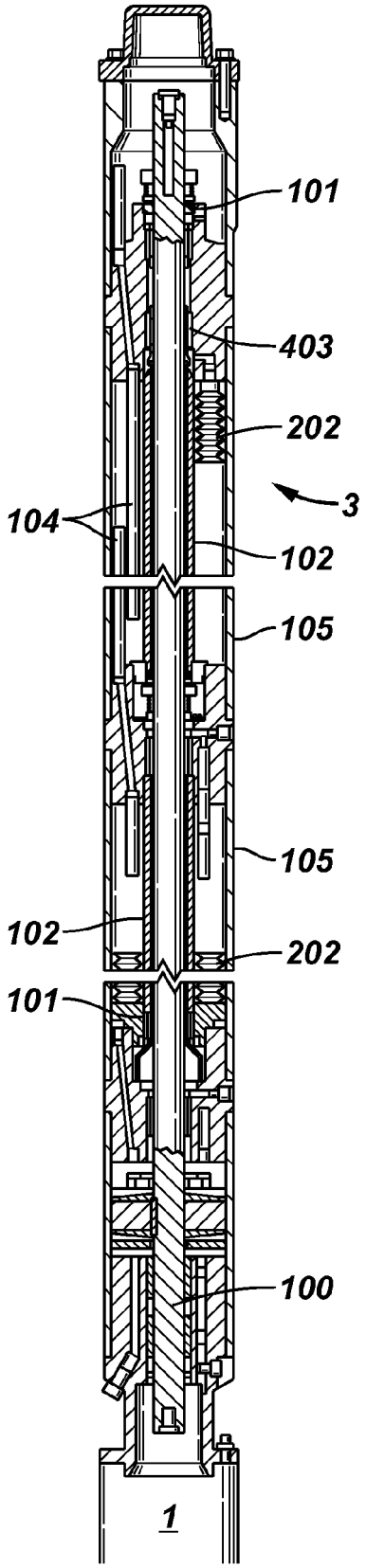
FIG. 2 shows embodiments of features.
Figure 3:
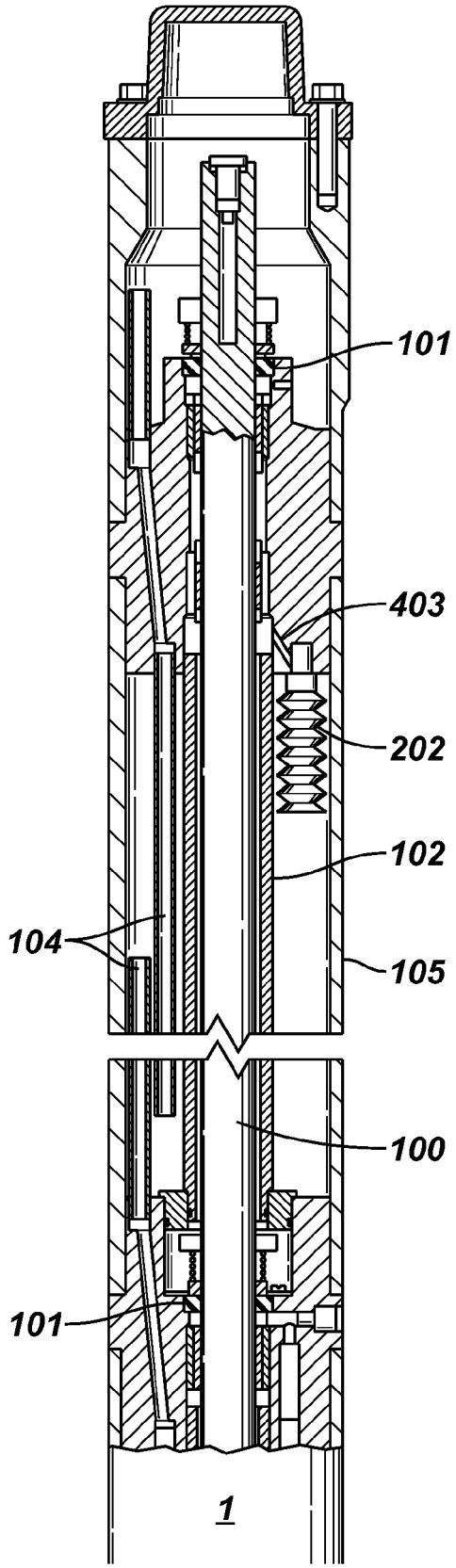
FIG. 3 shows embodiments of features.

FIGS. 2 and 3 show a protector part 3 having a labyrinth protector 104 and a shaft tube 102 sealed off from the fluid in the chamber in the protector part 3. A motor part 1 is shown in fluid connection with a compensation element 202 that is a bellows, preferably the compensation element 202 extends around the shaft 100 and has an inner part and an outer part forming a space therein that is sealed at the end away from the motor part 1, thereby defining the bellows enclosure. Furthermore, to compensate for thermal expansion and contraction of fluid, e.g., motor fluid, inside the shaft tube 102, a small compensation element 202 (e.g., metal bellows, bag, or piston) may be provided in connection with a communication path 403, e.g., an opening in the shaft tube 102. The labyrinth protector chamber 104 is shown as being part of a redundant seal arrangement. The ends of the shaft tube 102 are preferably sealed. An O-ring (or other seal) is installed for completely sealing off the space inside the shaft tube 102 from the surrounding chamber. When the inner space of the shaft tube 102 is sealed, the shaft tube 102 should have a compensation element 202 to handle the volume expansion and contraction due to temperature variations for oil inside the shaft tube 102, so that the pressure inside the shaft tube 102 will be generally balanced with the pressure outside of the shaft tube 102. Otherwise, if the space inside the shaft tube 102 experiences a high positive pressure, the shaft seal 101 on the top may be lifted open. If the inside of the shaft tube 102 sees excessive negative pressure, the shaft seal 101 below the labyrinth section may be lifted open. Either way, excessive positive/negative pressure may compromise the protector section 3 by opening or damaging a sealing element.

As noted above, the compensation element 202 can be a small metal bellows either axially or radially expanding, an elastomer bag, or a piston (or other volume compensating mechanism), depending on the applications. For conventional applications, a small elastomer (or other oil resistant, expandable material) bag may be sufficient. For high temperature or high corrosive application, a small metal bellows or a small piston may be a most appropriate choice. The compensating element may be coaxial with the shaft 100 or non-coaxial with the shaft 100.

The protector section 3 can be combined with any other sections or components of the protectors, such as additional labyrinth protector sections, bag protector sections, metal bellows protector sections, piston protector sections, and so forth. Furthermore, the sealed shaft tube space described above can be replaced with a space other than the shaft tube space. For example, the space could be formed with a (curved) tube that connects the lower end of the shaft seal on the top and the upper end of the shaft seal at the bottom (not shown). Also, it could be a volume isolated by multiple shaft seal parts or other divides.

Figure 4A:
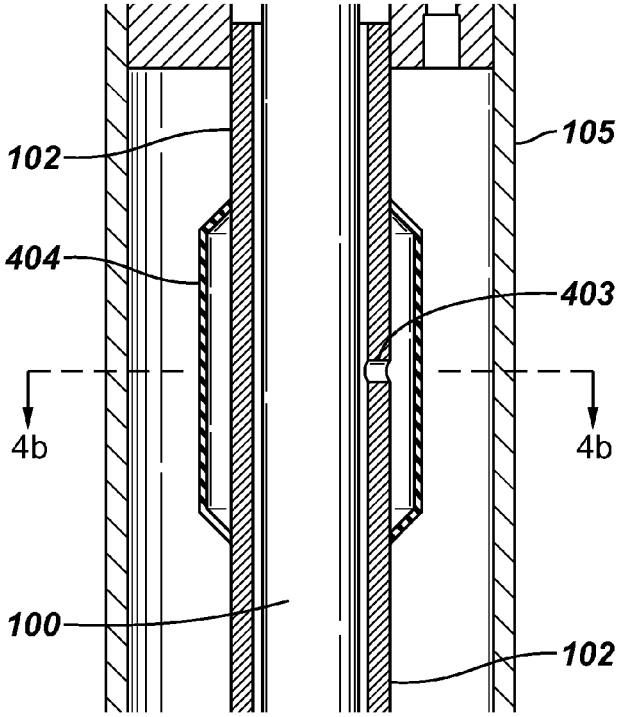
FIGS. 4A-C show embodiments of features.
Figure 4B:
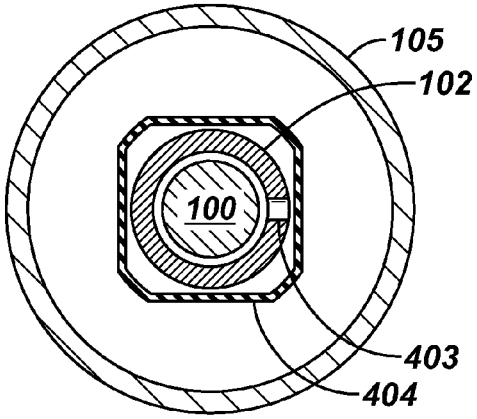
Figure 4C:
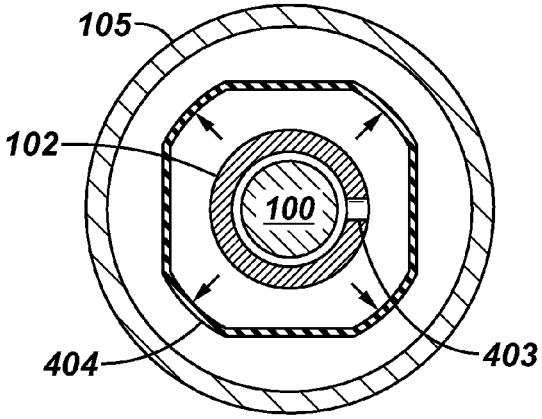

FIGS. 4A-C show a compensating element in the form of expandable diaphragm 404 (e.g., rubber or elastomer or even a metal sleeve) sealed around a communication path in the shaft tube 102. The expandable diaphragm 404 provides volume compensation. A shaft tube 102 is shown being around the shaft 100. The shaft tube 102 can be an elongated axially extending tubular member. As alluded to earlier, a situation could arise where fluid within the shaft tube 102 would thermally expand. Thus, as shown in FIGS. 4A-C the communication path 403 allows excess fluid in the shaft tube 102 to escape into the expandable diaphragm 404 thereby relieving pressure. The expandable diaphragm 404 could be a bellows. FIG. 4A shows the communication path 403 in the shaft tube 102 connecting with an inside of the expandable diaphragm or bellows 404. The expandable diaphragm 404 is shown as being connected around a circumference of the shaft tube 102 above and below the communication path 403. FIG. 4B shows the expandable diaphragm 404 in a contracted state. FIG. 4C shows the expandable diaphragm 404 in an expanded state.

Figure 5:
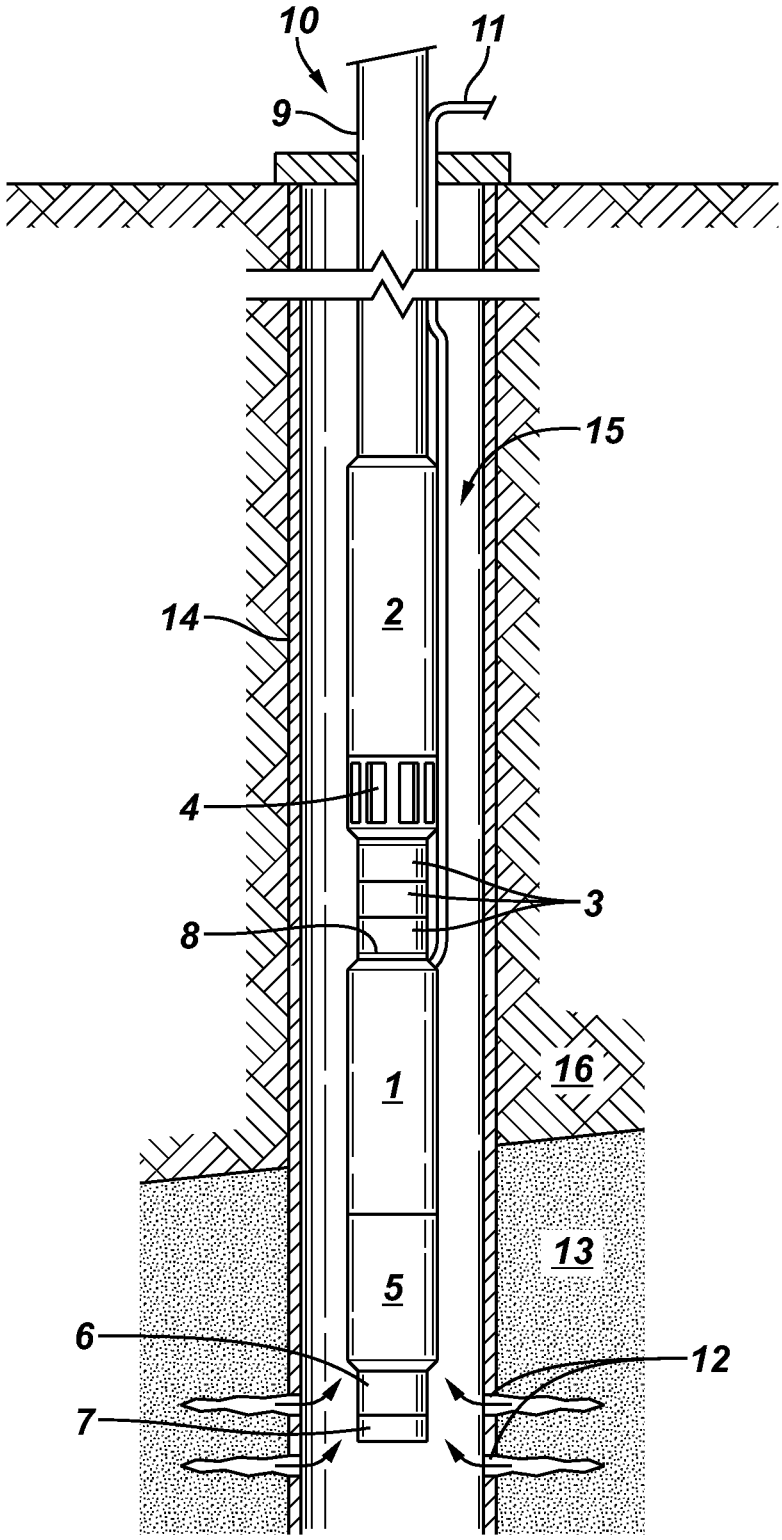
FIG. 5 shows embodiments of features.

FIG. 5 in the present application schematically shows an electric submersible pumping device in a well 10. The well 10 is drilled into earth strata 16 and into formation 13. The well 10 is cased with a casing 14. The electric submersible pumping device has a motor part 1 and a pump part 2. The motor part 1 can have motor fluid therein. A protector part 3 is coupled between the motor part 1 and the pump part 2 and includes a number of shaft seal parts 33 (shown in FIG. 6). The protector part 3 is adapted to allow for expansion and discharge of excess motor fluid while deterring and/or preventing ingress of well fluids toward the motor part 1, e.g., upon any thermal contraction. A compensation element 5 is located below the motor part 1 to allow for motor fluid expansion and contraction. A cooler 7 and a gauge 6 can also be included. The pump part 2 is connected to jointed or coiled tubing 9. The pump part 1 can be a centrifugal style pump or other rotating style pumps. The motor part 1 receives power from a power cable 11 extending from uphole. A thrust bearing 8 can be located between the protector part 3 and the motor part 1. A production fluid flow 12 is shown traveling into an intake 4 associated with the pump part 2.

Figure 6:
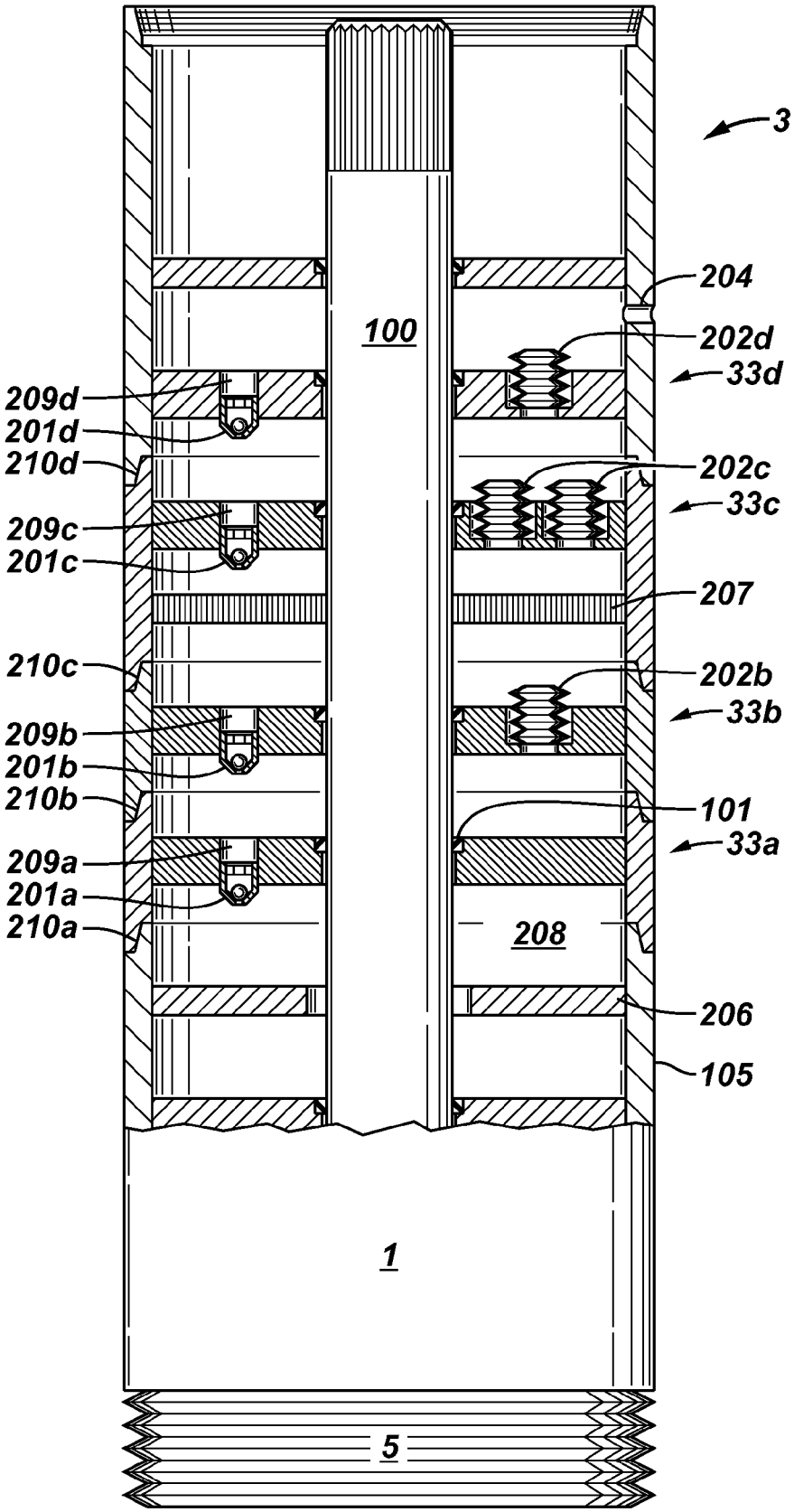
FIG. 6 shows embodiment of features.

FIG. 6 is a cutaway schematic of an embodiment of a protector part 3, including shaft seal parts 33*a-d*. A motor part 1 has a motor compensating element 5 connected below the motor part 1. Typically the motor compensating element 5 has a compensating volume of at least 1/10 the maximum oil capacity of the motor part 1, e.g., 1/6. The compensating elements 33*a-d* in the protector part 3 have an aggregate compensating volume of typically less than 1/20 the maximum oil capacity of the motor part 1, though it may range as low as 1/50, or 1/75, 1/100 or smaller, for example. The motor part 1 has a drive shaft 100 extending there from in an axial direction. The motor compensating element 5 is shown as being a bellows, preferably metal. The motor compensating element 5 could take many forms however, including but not limited to a bladder or a piston, or any other expandable and contractible vessel defining a correspondingly expandable and contractible volume. The protector part 3 is above the motor part 1 and has shaft seal parts 33*a-d* that surround the shaft 100. The protector part 3 can have a longitudinally extending tubular casing 105 that has an inner surface defining an inner volume. Each of the shaft seal parts 33*a-d* is located in that inner volume and can be coupled between the inner surface of the casing 105 and the shaft 100. It is not necessary that the shaft seal parts 33*a-d* and the shaft 100 be in direct contact though such is possible. Each of the shaft seal parts 33*a-d* has a shaft seal 101 that is adjacent to the shaft 100. Each shaft seal 101 can incorporate elastomeric material so as to conform closely to the surface of the shaft 100. Each shaft seal 101 could also incorporate metal, ceramic, or polymer. Each of the shaft seal parts 33*a-d* acts to divide the volume in the protector part 3, e.g., to divide the protector part 3 into separate fluid containing volumes sequentially fluidly isolating the motor part 1. The shaft 100 extends in the axial direction from the motor part 1 into the protector part 3 and up into a pump part 2 (not shown). A sprocket 206 is shown and forms a bubble sump 208 between the sprocket 206 and a first shaft seal part 33*a*. The bubble sump 208 is a chamber that collects bubbles that can rise in oil of the motor part 1 in a chamber that isolates the bubbles.

In practice, it is difficult to determine a precise amount of motor oil to meet requirements while avoiding overfilling a motor part 1, given a scale of temperatures and resulting thermal expansion that the motor parts 1 may be subjected to. Also, the motor oil undergoes much greater thermal contraction and expansion from manufacture (e.g., 75° F.), to shipping and storage (e.g., −40° F.), to installation (e.g., 60° F.), to operation (e.g., 600° F.), to non-operation (e.g., 500° F.). Thus, without relief valves, compensation of much greater capacity would be required. Accordingly, a motor compensating element 5 is provided, and the first shaft seal part 33*a* has a relief valve 201*a*. The relief valve 201*a* can be biased to preferentially only allow flow away from the motor part 1 during normal operation. The relief valve 201*a* is in a flow path that extends across the first shaft seal 33*a*, e.g., through opening 209*a*. Provision of the relief valve 201*a* is to allow for excess fluid to escape from the motor part 1 and is beneficial as it allows for self regulation of fluid volume in the motor part 1.

Above the first shaft seal part 33*a* is a second shaft seal part 33*b* having a relief valve 201*b* and a compensating element 202*b*. In a situation where it is desired to more perfectly isolate the motor part 1 fluidly from a protector part, or more perfectly fluidly isolate volumes between shaft seal parts, the relief valve 201*b* may be excluded and a relief valve may be provided connecting the motor part 1 to the wellbore. The compensating element 202*b* is shown as being non-coaxial with the motor part 1, the pump part 2, the casing 105 and the shaft 100, but the compensating element 202*b* may be coaxial too. The relief valve 201*b* is a biased one-way valve and a flow path that extends across the second shaft seal part 33*b*, e.g., through the opening 209*b*. The compensating element 202*b* is an expandable and contractible vessel defining an internal volume that is correspondingly expandable and contractible. The compensating element 202*b* compensates pressure across the shaft seal divide. For example, the compensating element 202*b* could be a bellows. The bellows can be metal bellows, but could be other materials. The compensating element 202*b* could also be a piston or a bladder. Those features can apply to all compensating elements discussed in the present application.

Above the second shaft seal part 33*b* is a third shaft seal part 33*c* having a relief valve 201*c* and two compensating elements 202*c*, both shown as being bellows. Again, in a situation where it is desired to isolate the motor part 1 hydraulically from the protector part, or hydraulically isolate the volumes defined between the shaft seal parts, the relief valve 201*c* could be excluded. The relief valve 201*c* can be one-way valve and in a flow path that extends across the second shaft seal part 33*b*, e.g., through the opening 209*c*. The relief valve 201*c* can be biased to only allow flow away from the motor part 1.

Above the third shaft seal part 33*c* is a fourth shaft seal part 33*d* having a relief valve 201*d* and a compensating element 202*d* shown as being a bellows. Again, in a situation where it is desired to more perfectly isolate the motor part 1 hydraulically from the protector part, or the volumes between the shaft seal parts, the relief valve 201*d* could be excluded. The relief valve 201*d* can be a one-way valve and in a flow path that crosses the shaft seal part 202*d*, e.g., through the opening 209*d*. A chamber is above the fourth shaft seal part 33*d* and has a relief passage 204*d* leading to the wellbore 15. The relief valve 201*d* could be biased to only allow flow away from the motor part 1.

During operation, given the embodiment shown in FIG. 6, self regulation of a volume of fluid in the motor part 1 can occur. The motor part 1 can be filled with motor fluid at manufacture or installation. As the fluid in the motor part 1 becomes heated and thermally expands, the motor compensating element 5 expands to compensate for that expansion. If too much fluid is put in to account for thermal expansion, the motor compensating element 5 reaches capacity, the fluid in the motor part 1 expands beyond the capacity of the motor part 1 and the motor compensating element 5, and any excess fluid passes through the relief valve 201*a* and into the volume past the first shaft seal part 33*a*. A relief valve could lead through the casing 105 to the wellbore. The excess fluid passing through the first relief valve 201*a* expands compensating element 202*b*. If the compensating element 202*b* reaches capacity, excess fluid passes through relief valve 201*b*. Additionally, the expansion of compensating element 202*b* displaces a volume after the shaft seal part 33*b*. The fluid passing above the second shaft seal part 33*b*, in addition to the displaced volume from the compensating element 202*b*, expands the compensating element 33*c*. If the two compensating elements 33*c* reach capacity, any excess fluid passes through the relief valve 201*c* and expands compensating element 202*d*. If compensating element 202*d* reaches capacity, any excess fluid passes through relief valve 201*d* and out relief passage 204*d* into the wellbore 15.

As shown in FIG. 6, upon cooling of the motor part 1 and corresponding fluid, the motor compensating element 5 will contract thereby compensating for the thermal contraction of the fluid in the motor part 1. Fluid in the protector part 3 can cool and contract too. However, any of the excess fluid that passed through the relief valve 201*a* will be prevented from returning to the motor part 1. Upon cooling of the fluids in the volumes between the shaft seal parts 33*a-d*, the compensators 202*b-d* can contract and compensate for thermal contraction.

A feature of the present application relates to the comparative size of the motor compensating element 5 and the compensating elements 202*b-d* in connection with the idea of self regulation of the amount of fluid in the motor part 1. That is, the motor compensating element 5 is sized so that it can substantially be expected to compensate for all thermal expansion of fluids in the motor part 1. For example, the compensating elements 202*b-d* in aggregate may have a much smaller volume than the motor compensating element 5, e.g., preferably at most 1/10 the volume of the motor compensating element 5. Alternatively, the ratio of the volume in the compensating elements 202*b-d* and the motor compensating element 5 could be approximately 2/10, 3/10, 2/5 or 1/2. Given the configuration in FIG. 6, the small volumes of the compensating elements 202*b-d* along with the relief port 204, allow for self regulation of the amount of motor fluid in the motor part 1 on initial filling through expansion and contraction. In other words, the spaces between the shaft seal parts 33*a-d* are isolated on contraction by the relief valves 201*a-d* thereby preventing back-flow into the motor part 1.

It should be noted that additional shaft seal parts and compensators can be added with those shown in FIG. 6 in any number or order. Also, the order shown in FIG. 6 is merely exemplary of an embodiment and is not limiting.

It is preferable that the first shaft seal part 33*a* have only a relief valve 201*a*. However, it should be appreciated that there are many variations of configurations that the shaft seal parts 33*a-d* can take. For example, a compensating element preferably at most 1/10 the volume of the motor compensating element 5 may be added to shaft seal part 33*a* without compromising the ideas herein. For example, the shaft seal part 33*d* could be located anywhere in the sequence, e.g., directly after the first shaft seal part 33*a*. Also, the shaft seal part 33*b* could have one compensating element 202*b* and the shaft seal part 33*c* could have one compensating element 202*c*. Alternatively, the two compensating elements 33*c* could be replaced with a single compensating element 33*c* having the same overall maximum volume displacement. Alternatively, more than two compensating elements 33*c* could be used. Also, again, the relief valves could be excluded.

A filter 207 can be provided. FIG. 6 shows the filter being provided between the second shaft seal part 33*b* and the third shaft seal part 33*c*, in a fluid flow path. However, the filter 207 could be placed in almost any location provided that the filter 207 is in the fluid flow path and fluid passes across one shaft seal part to another through the filter 207. The filter 207 could be placed above the fourth shaft seal part 33*c*, or even below the first shaft seal part 33*a*. More than one filter 207 can be used in different locations too. The filter 207 can help prevent ingress of particles or other contaminants in well fluid toward the motor part 1.

Figure 7:
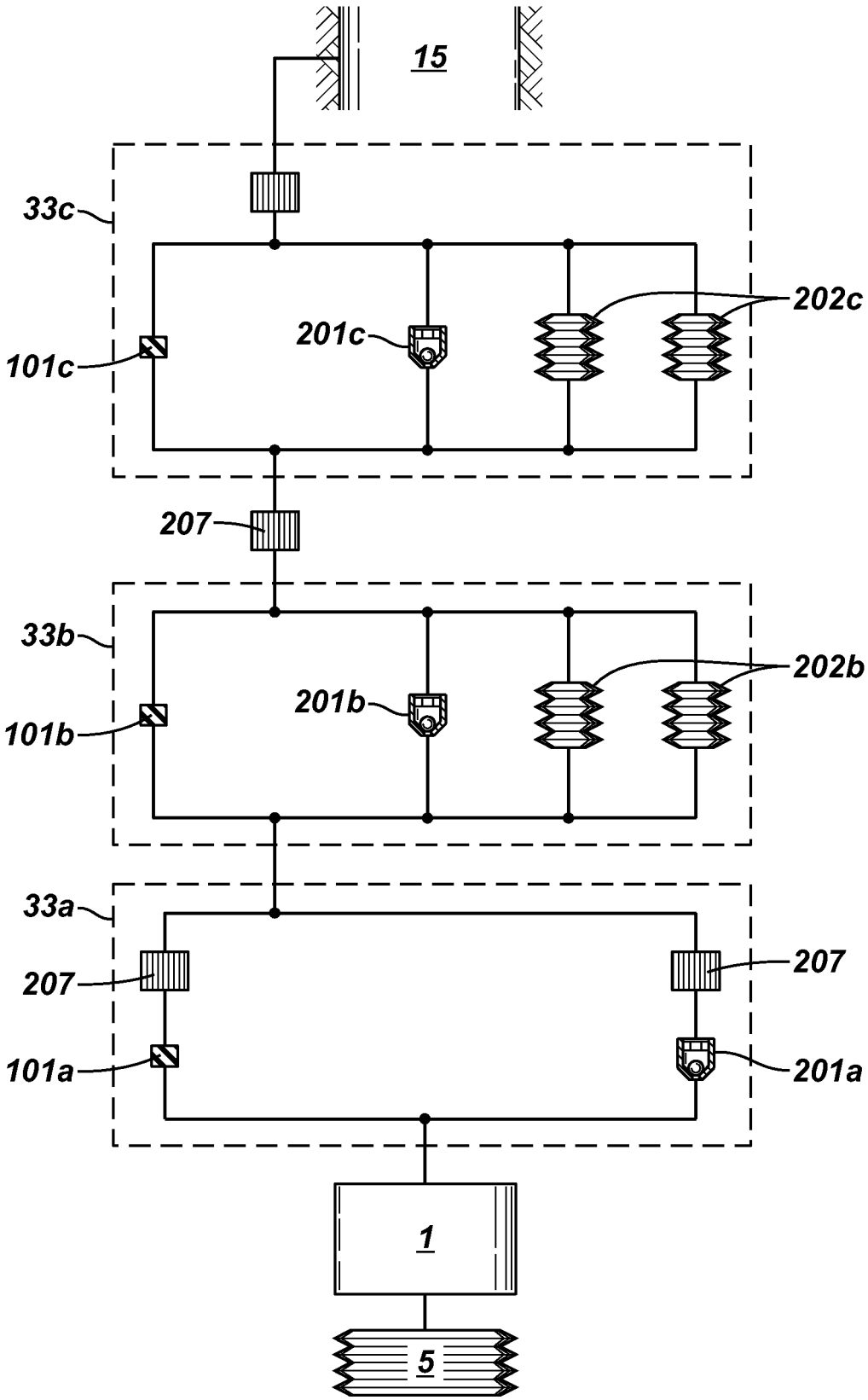
FIG. 7 shows embodiments of features.

FIG. 7 is a hydraulic circuit diagram illustrating ideas embodied in the other figures in the present application relating to an electric submersible pumping device, and related components therein. FIG. 7 shows three shaft seal parts 33*a-c*, delineated by dotted lines. The solid lines illustrate fluid flow paths. A motor 1 is shown having a motor compensating element 5 connected below the motor 1. The motor compensating element 5 can be a bellows. The first shaft seal part 33*a* is above the motor part 1 and has a shaft seal 101*a* in one fluid flow path. A filter 207 is after the shaft seal 101*a* and is in a flow path. A relief valve 201*a* is in another fluid flow path. The relief valve 201*a* can be a one-way valve, e.g., a biased valve biased to preferentially only allow flow away from the motor part 1. A filter 207 follows the relief valve 201*a*. FIG. 7 shows two separate filters 207 in the first shaft seal part 401, but those two filters 207 could be replaced by a single filter 207 or more than two filters 207. A protector part could be a filter in and of itself.

The first shaft seal part 33*a* leads into the second shaft seal part 33*b*. A fluid flow path in the second shaft seal part 33*b* is through a shaft seal 101*b*. Preferably that path is blocked fully by the shaft seal 101*b*. Another parallel fluid flow path is through a relief valve 201*b* that is a one-way valve that could be biased to preferentially allow flow away from the motor part 1. Another parallel fluid flow path is through a compensating element 202*b* that is shown as being a bellows. A filter 207 is shown outside of the second shaft seal part 101*b*. It should be noted that the filter 207 in the second shaft seal part 33*b* is outside the dotted line, but could be inside the dotted line, e.g., a shaft seal part could be considered as including or excluding a filter 207 depending on preferred design.

The second shaft seal part 33*b* leads into the third shaft seal part 33*c*. As noted above, the filter 207 is located between the second shaft seal part 33*b* and the third shaft seal part 33*c*. The third shaft seal part 33*c* has a shaft seal 101*c* blocking one fluid flow path. Preferably the shaft seal 101*c* entirely blocks that fluid flow path. A relief valve 201*c* is in another parallel fluid flow path, the relief valve being preferably one-way, e.g., biased to preferentially only allow flow away from the motor part 1. Two compensating elements 202*c* block the remaining parallel fluid flow paths. A single filter 207 is shown as being within the third shaft seal part 33*c* but could also be outside the third shaft seal part 33*c*. Also, multiple filters 207 could be used. The third shaft seal part 33*c* could lead to the wellbore 15.

During operation, as shown in FIG. 7, fluid in the motor part 1 can be subjected to thermal expansion. Upon expansion, that fluid can expand into the motor compensating element 5. If the thermally expanded fluid never exceeds the maximum capacity of the motor part 1 and the motor compensating element 5, the shaft seal parts 33*a-c* could have no relief valves and be hydraulically isolated while protecting the motor part 1. However, in a case where the fluid does exceed the volume of the motor part 1 and the motor compensating element 5, provision of relief valves 201*a-c* can be more beneficial than providing a single relief valve from the motor part 1 and motor compensating element 5 directly to the wellbore 15, because such a relief valve provides only a single barrier to well fluid entry and is exposed directly to a harmful wellbore environment. For example, when the motor compensating element 5 reaches maximum capacity the fluid can expand through the relief valve 201*a* of first shaft seal part 33*a*. The shaft seal 101*a* preferably blocks all the fluid from traveling along that path. The fluid preferably travels through relief valve 201*a* in the first shaft seal part 33*a*. The fluid travels through filters 207.

The fluid then expands into the second shaft seal part 33*b* and expands into the compensating element 202*b*. Preferably, no fluid travels through the path blocked by the shaft seal 101*b*. Once the compensating element 202*b* reaches maximum capacity any excess fluid will travel through the relief valve 201*b* and through the filter 207 into the third shaft seal part 33*c*.

The fluid passes through the third shaft seal part 33*c* thereby displacing fluid. Also, displacement is caused by expansion of the compensating element 202*b*. Thus, the fluid expands both compensating elements 202*c* thereby displacing adequate volume. Once the compensating elements 202*c* reach maximum capacity any excess volume passes through the relief valve 201*c* through the filter 207 and to the wellbore 15.

Upon cooling of the fluid in the motor part 1, the motor compensating element 5 will contract and compensate for thermal contraction of the fluid. When the volume of fluid isolated between the shaft seal parts 33*a-c* thermally contracts the compensating elements 202*b* and 202*c* compensate for such.

Some additional features relate to the assembly of the protector part 3. As shown in FIG. 6, the parts of the casing 105 connecting to respective shaft seal parts 33*a-d* can be connected together by way of threaded connections 210*a-d*. The threaded connections can extend around the circumference of the parts of the casing 105. Threaded connections 210*a-d* allow for simplification of installation as the shaft seal parts 33*a-d* can be lowered over the shaft 100 and threaded into place.

While a number of embodiments relating to the inventive concept are discussed in the present application, those skilled in the art will appreciate numerous modifications and variations from those embodiments are contemplated and intended. It is intended that the appended claims cover such modifications and variations as fall within the true spirit and scope thereof.

The invention claimed is:

1. An electric submersible pump device, comprising:

an electric submersible motor part that produces torque having coupled thereto a drive shaft that transmits the torque, the drive shaft extending in an axial direction from the motor part;

a protector part coupled with the motor part, the drive shaft extending into the protector part, the protector part comprising a tubular shaped casing extending in the axial direction;

a shaft tube surrounding a portion of the drive shaft thereby defining an interior space between an outer surface of the shaft and an interior of the shaft tube, the interior space isolated from the motor part by at least one seal, and defining a circumferential exterior space between an exterior of the shaft tube and a circumferential interior of the tubular shaped casing;

a first shaft seal at a first end of the shaft tube;

a second shaft seal at a second end of the shaft tube;

a passage in fluid communication with the interior space via an opening in the shaft tube; and a compensating element disposed at least partially in the exterior space and in fluid communication with the passage, the compensating element being an expandable and contractible vessel defining a volume that is correspondingly expandable and contractible to pressure-balance the interior space to prevent excessive positive and negative pressures on the first and second shaft seals.

2. The electric submersible pump device of claim 1, comprising: a motor compensating element in fluid connection with the motor part, the motor compensating element being an expandable and contractible vessel defining a volume that is correspondingly expandable and contractible.

3. The electric submersible pump device of claim 1, wherein the compensating element is a metal bellows.

4. The electric submersible pump device of claim 1, wherein the compensating element is a piston.

5. The electric submersible pump device of claim 1, wherein the compensating element is an elastomeric bladder.

6. The electric submersible pump device of claim 1, wherein the compensating element is non-coaxial with the shaft.

7. The electric submersible pump device of claim 2, wherein the motor compensating element is a metal bellows.

8. The electric submersible pump device of claim 1, comprising a labyrinth protector seal.

9. The electric submersible pump device of claim 1, comprising a pump part coupled with the drive shaft.

* * * * *